US005763374A

United States Patent [19]

Sakai et al.

[11] Patent Number: 5,763,374

[45] Date of Patent: Jun. 9, 1998

[54] LUBRICATING OIL COMPOSITIONS OF REDUCED HIGH-TEMPERATURE HIGH-SHEAR VISCOSITY

[75] Inventors: Kouzou Sakai; Hidehiko Matsuya; Yoshihisa Ohta, all of Kyoto, Japan

[73] Assignee: Sanyo Chemical Industries, Ltd., Kyoto, Japan

[21] Appl. No.: 513,562

[22] Filed: Aug. 10, 1995

[30] Foreign Application Priority Data

| | | | |
|---|---|---|---|
| Aug. 10, 1994 | [JP] | Japan | 6-210476 |
| Nov. 2, 1994 | [JP] | Japan | 6-293821 |
| Dec. 6, 1994 | [JP] | Japan | 6-330607 |
| Apr. 21, 1995 | [JP] | Japan | 7-120919 |

[51] Int. Cl.[6] ..... C10M 145/14

[52] U.S. Cl. ..... 508/469

[58] Field of Search ..... 508/469

[56] References Cited

U.S. PATENT DOCUMENTS

| | | | |
|---|---|---|---|
| 2,604,453 | 7/1952 | Popkin | 508/469 |
| 2,655,479 | 10/1953 | Munday et al. | 508/469 |
| 2,996,455 | 8/1961 | Brown et al. | 508/469 |
| 3,833,501 | 9/1974 | Elliott et al. | 508/469 |
| 5,368,761 | 11/1994 | Gore et al. | 508/469 |
| 5,534,175 | 7/1996 | Cantiani | 508/469 |

FOREIGN PATENT DOCUMENTS 1372699 11/1974 United Kingdom .

OTHER PUBLICATIONS

Smalheer & Smith, Lubricant Additives, 1967.

*Primary Examiner*—Jerry D. Johnson

*Attorney, Agent, or Firm*—Oblon, Spivak, McClelland, Maier & Neustadt, P.C.

[57] ABSTRACT

A viscosity index improver, comprising an oil-soluble copolymer (A) having 20–70% by weight of alkyl acrylate units and 30–80% by weight of alkyl methacrylate units, and a viscosity index improver, comprising 20–80% by weight of an oil-soluble alkyl acrylate (co)polymer (A1) and 20–80% by weight of an oil-soluble methacrylate (co) polymer (A2), are capable of reducing high-temperature high-shear viscosity, particularly isoparaffin-containing high viscosity index oil, and provide luburicating oils useful as engine oil, gear lubricant and so on.

16 Claims, No Drawings

LUBRICATING OIL COMPOSITIONS OF REDUCED HIGH-TEMPERATURE HIGH-SHEAR VISCOSITY

BACKGROUND OF THE INVENTION

1. Field of the Invention

This invention relates to a lubricating oil composition and a viscosity index improver (hereinafter referred to as VII) therefor.

2. Description of the Prior Art

It has been heretofore proposed to use high viscosity index (hereinafter referred to as VI) oils, such as those formed by hydrogenolysis of n-paraffins or by hydrogenation and ring-opening reaction of polycyclic aromatics or naphthenes, as base oils for lubricating oils, such as automobile lubricating oils.

There have been desired VIIs effective for high VI oils; since known VIIs, such as alkyl nethacrylate polymers (hereinafter referred to as PMA), olefin copolymers (hereinafter referred to as OCP) and mixtures of them, added to high VI oils, result in increased viscosity at high-temperature high-shearing (hereinafter referred to as HTHS viscosity) and increase of fuel cost and do not provide sufficiently reduced low temperature viscosity.

SUMMARY OF THE INVENTION

It is an object of the present invention to provide a VII, particularly effective for high VI oils.

It is another object of this invention to provide a VII capable of providing reduced HTHS viscosity, when added to high VI oils.

It is still another object of this invention to provide a high VI oil composition of improved resistance to friction and wear and capable of providing lower fuel cost.

It is yet another object of the invention to provide a lubricating oil composition of reduced low-temperature viscosity.

Briefly, these and other objects of the present invention as hereinafter will become more readily apparent have been attained broadly by adding a VII comprising an oil-soluble copolymer (A) having 20–70% by weight of units of at least one alkyl acrylate (a1) and 30–80% by weight of units of at least one alkyl methacrylate (a2) to an isoparaffin-containing high VI oil (B); or by adding a VII comprising 20–80% by weight of an oil-soluble alkyl acrylate polymer (A1) and 20–80% by weight of an oil-soluble methacrylate polymer (A2) to a lubrication base oil.

DETAILED DESCRIPTION OF THE PREFERRED EMBODIMENTS

Oil-soluble Copolymer (A)

Suitable alkyl acrylates (a1), constituting said alkyl acrylate units of said copolymer (A), are straight-chain or/and branched alkyl acrylates containing usually 1–22 carbon atoms in the alkyl group; and include, for example (a1-1) $C_{5-10}$alkyl acrylates, such as pentyl, hexyl, heptyl, octyl, 2-ethylhexyl, decyl and i-decyl acrylates; (a1-2) $C_{1-4}$alkyl acrylates, such as methyl, ethyl, propyl, i-propyl, n-butyl, i-butyl and t-butyl acrylates; $C_{11-22}$ alkyl acrylates, such as dodecyl, tridecyl, tetradecyl, pentadecyl, hexadecyl, octadecyl and eicocyl acrylates; and combinations of two or more of them. Among these, preferred are those containing not more than 10 carbon atoms in the alkyl group. More preferred are (a1-1) (particularly octyl and/or 2-ethylhexyl acrylate), and combination thereof with (a1-2). Preferably, (a1) contains at least 60%, particularly 60–90% of (a1-1) and 0–40% particularly 10–40% of (a1-2). In the above and hereinafter, % represents % by weight, unless otherwise specified.

Suitable alkyl methacrylates (a2), constituting said alkyl methacrylate units of said copolymer (A), are straight-chain or/and branched alkyl methacrylates containing usually 1–22 carbon atoms in the alkyl group; and include, for example, (a2-1) $C_{10-18}$alkyl methacrylates, such as decyl, i-decyl, dodecyl, tridecyl, tetradecyl, pentadecyl, hexadecyl and octadecyl methacrylates; (a2-2) $C_{1-4}$alkyl methacrylates, such as methyl, ethyl, propyl, i-propyl, n-butyl, i-butyl and t-butyl methacrylates; $C_{5-9}$ alkyl methacrylates, such as pentyl, hexyl, heptyl, octyl and 2-ethylhexyl methacrylates; $C_{20-22}$alkyl methacrylates, such as eicocyl methacrylate; and combinations of two or more of them.

Among these, preferred are those containing at least 10 carbon atoms in the alkyl group. More preferred are (a2-1) (particularly $C_{12-18}$alkyl methacrylate and mixture of two or more of them), and combination thereof with (a2-2). Preferably, (a2) contains 60–95% of (a2-1) and 5–40% of (a2-2). Particularly preferred are (a2) containing 10–65% of $C_{12-13}$alkyl methacrylate, 10–65% of $C_{14-15}$alkyl methacrylate, 0–30% of $C_{16-18}$alkyl methacrylate and 0–30% of $C_{1-4}$alkyl methacrylate.

The content of units of said alkyl acrylate (a1) in said copolymer (A) is usually at least 20%, preferably at least 40% based on the weight of (A), for the purpose of providing reduced HTHS viscosity, and is generally not more than 70%, preferably not more than 60%, in view of lower coking amount at elevated temperature of engine oil. The content of units of said alkyl methacrylate (a2) in said copolymer (A) is usually 30–80%, preferably 40–60%.

Said oil-soluble copolymer (A) can further contain, in addition to units of (a1) and (a2), units of one or more additional monomers, if desired, which may be introduced randomly, graft-wise or block-wise.

Suitable monomers include polar monomers (a3) containing at least one atom selected from the group consisting of nitrogen, oxygen and sulfur, for example, ones capable of imparting detergency, sludge-dispersibility or anti-oxidant action to VII, such as those disclosed in U.S. Pat. Nos. 5,013,468, 5,013,470, 4,606,834, 4,036,766, 4,036,768, 4,904,404, 4,812,261, 4,668,412, 4,790,948 and 4,795,577, and EP 518012. Illustrative of suitable monomers (a3) are ones to be graft copolymerized, for example, N,N-dialkylaminoalkyl (meth)acrylates and N,N-dialkylaminoalkyl(meth)acrylamides, containing 1–10 preferably 1–4 carbon atoms in each alkyl group and 2–10 carbon atoms in the alkylene group [such as N,N-dimethylaminoethyl, N,N-diethylaminoethyl, N,N-diethylaminohexyl, N,N-dimethylaminopropyl and N,N-dibutylaminooctyl (meth)acrylates, and corresponding dialkylaminoalkyl(meth)acrylamides]; heterocyclic nitrogen-containing vinyl monomers, such as N-vinylpyrrolidone, N-vinylthiopyrrolidone, vinylpyridines (such as 2-vinylpyridine), vinylimidazole, morpholinoalkyl (meth)acrylates, containing 2–4 or more carbon atoms in the alkylene group [such as morpholinoethyl and morpholinopropyl (meth)acrylates], and (meth)acrylate derivatives containing residue of hetero-cyclic amines such as aminophenothiazine, N-arylphenylenediamines, aminocarbazole, aminothiazole, aminoindole, aminopyrrrole, aminoimidazoline, aminomercaptothiazole and aminopiperidine; and mixtures of two or more of these monomers. In the above, (meth)acrylates represent acrylate and methacrylate; and similar expressions are used hereinafter. Among these, preferred are N-vinyl-pyrrolidone, N,N-dimethylaminoethyl methacrylate and N,N-diethylaminoethyl methacrylate.

Other examples of copolymer (A) containing graft-wise introduced monomer units (a3) include ones obtainable by copolymerization of a small amount (for instance, 0.5–5%) of an ethylenically unsaturated carboxylic acid [such as maleic, (meth)acrylic, crotonic and itaconic acids] or anhydride thereof (such as maleic anhydride) with said monomers (a1) and (a2), followed by amidation or imidation of the resulting copolymer with a (poly)amine or by Mannich reaction of the copolymer with formaldehyde and a (poly) amine; and ones obtainable by grafting, to a copolymer of (a1) and (a2), a non-vinyl compound [for example, heterocyclic amines, such as phenothiazines, imidazoles, thiazoles, benzothiazoles, triazoles, thiazolidines, pyrimidines, piperazines, pyrrolidinones, oxazoles and thiomorpholines], using a radical initiator or the like. The amount of (a3) in (A) is usually at most 20%, preferably at most 10%, more preferably at most 5%.

Other suitable additional monomers include non-polar or less hydrophilic monomers (a4), which may be randomly copolymerized with (a1) and (a2) or grafted onto substrate copolymer of (a1) and (a2). Exemplary of such monomers (a4) are unsaturated nitriles, such as (meth)acrylonitriles; aromatic vinyl compounds, such as styrene and vinyltoluene; esters (such as alkyl esters containing 1–30 carbon atoms in the alkyl group) of unsaturated mono- or polycarboxylic acid (such as crotonic, maleic, fumaric and itaconic acids), for example, butyl, octyl and dodecyl crotonates; dibutyl, dioctyl and dilauryl maleates, and dihexyl, dihexadecyl and dioctadecyl fumarates; vinyl esters (ones of fatty acids containing not sore than 5 carbon atoms), such as vinyl acetate and vinyl propionate; vinyl ethers containing 8–30 carbon atoms, such as methyl vinyl ether and butyl vinyl ether; olefins, including alpha-olefins containing 8–30 carbon atoms, such as decene-1 and dodecene-1, and so on. Among these, preferred are acrylonitrile and styrene, for imparting higher VI and bodying effects, respectively. The content of (a4) in (A) is generally at most 30%, preferably at most 20%, sore preferably at most 10%, in view of resistance to oxidation, low temperature viscosity behavior and solubility into lubricationg oils.

Copolymer (A) can be produced by usual polymerization thechniques, for instance, by radical polymerization of (a1) and (a2) with or without (a3) and/or (a4), within a solvent [for example, mineral oil, synthetic lubricating oils, such as hydrocabon lubulicants (decene oligomer and the like) and ester lubricants (dioctyl adipate, trimethylolpropane fatty esters]. There may be used any polymerization catalysts [for example, azo compounds, such as azobis-iso-butyronitrile (hereinafter referred to as AIBN) and azobis-valeronitrile (hereinafter referred to as AVN), and peroxides, such as benzoyl peroxide, cumyl peroxide and lauryl peroxide], with or without chain transfer agents [for example, mercaptans, such as lauryl mercaptan(hereinafter referred to as LM), and (alkyl)anilines, phenols, alcohols, amines and the like].

Said copolymer (A) is oil-soluble and is effective as a VII. Molecular weight of (A) can vary widely, according to the use and purpose of lubricating oil compositions. In general, (A) has a weight-average molecular weight (hereinafter referred to as $\overline{Mw}$), as measured by GPC (gel permeation chromatography) using calibration curve of polystyrene, of generally 10,000–500,000, preferably 20,000–200,000, more preferably 30,000–150,000. Polymer of too high molecualr weight causes degradation to form shorter chain polymer when subjected to shearing and cannot maintain necessary viscosity and VI for a long period of time. Polymer of too low molecular weight is to be used in a larger amount in order to attain sufficient viscosity. Preferably range of $\overline{Mw}$ is 20,000–150,000 when used in gear lubricants (such as manual transmission oil, differential gear oil, automatic transmission oil), 30,000–200,000 for use in hydraulic fluids (such as those for construction machines, power steering oil and shock-absorber oil), and 130,000–500,000 for engine oils (such as those for gasoline and diesel engine)

Isoparaffin-containing High VI Oil (B)

High VI oils (B), to which said copolymer (A) is added, are quite different, with respect to composition and properties, from usual lubricating oils obtained by solvent refining of mineral oils. Suitable high VI oils include ones containing i-paraffins obtainable by hydrocracking and isomerizing n-paraffins with use of a catalyst (such as noble metal catalyst), as disclosed in Neth.Appln.76 13854. Isomerized mineral oils containing i-paraffins thus prepared may be further solvent refined. Other examples of suitable high VI oils are ones containing i-paraffins and monocyclic naphthenes obtainable by hydrogenation and ring-opening reaction of polycyclic aromatics or polycyclic naphthenes. These high VI oils generally contains i-paraffins containing 15–35 carbon atoms in an amount of 20–80%, preferably 30–70%. These oils have a VI of usually 110–160, preferably 120–160; while usual mineral oils obtained by solvent refining generally have a VI of 90–105.

High VI oil (B) may be used alone as the base oil, or may be used in combination with one or more other base oils, such as usual mineral oils, synthetic lubricants and MLDW oils. Usual mineral oils include ones obtained from vacuum distilled oils or de-bitumened oils, by removing aromatics therefrom with furfural and then dewaxing with use of a solvent (such as toluene/methylethylketone mixed solvent or propane). Synthetic lubricants include ester lubricants, such as fatty esters of polyhydric alcohols (such as trimethylolpropane, pentaerythritol and 1,6-hexane diol), fatty alcohol esters of polycarboxylic acids (such as adipic acid), and polyolefin lubricants, for example, poly-alpha-olefins, such as decene-1 oligomer. MLDW oils are ones prepared by mobil lube dewaxing process, and include ones obtainable by isomerizing wax with a catalyst (such as synthetic zeolite) and removing unreacted wax.

The content of high VI oil (B) in the base oil is usually 30–100% by volume, preferably 50–100% by volume, more preferably 70–100% by volume.

Lubricating Oil Composition

The lubricating oil composition of the present invention usually contains said oil-soluble copolymer (A) in a minor portion as VII, such as in an amount of usually 0.3–30%, preferably 0.6–10%, and said high VI oil (B) in a major portion, such as in an amount of 65–99.65%, preferably 85–99.35%.

Said copolymer (A) may be added to the oil in the form of a concentrate, for example, 30–80% solution of (A) in a solvent (such as high VI oil or other oil).

The lubricating oil composition may contain one or more additives, as described below.

Molybdenum-containing Antiwear Agent (C)

In a preferable embodiment of this invention, the lubricating oil composition further contains a molybdenum-containing antiwear agent (or friction modifier) (C). Suitable antiwear agent (C) include molybdenum thiophosphates and molybdenum carbamates, as disclosed in U.S. Pat. No. 4,098,705. Illustrative of (C) are molybdenum dithiophosphate and molybdenum carbamate. Excellent resistance to friction and wear and lower fuel cost can be attained by adding said agent (C) together with said copolymer (A) to said high VI oil (B). Said agent (C) is used in an amount of usually 0.05–5%, preferably 0.1–3%, for this purpose.

Pouring Point Depressant (D)

Preferably, the composition of this invention may further contain a pouring point depressant (D). Suitable depressant (D) include polyalkyl methacrylates, such as (copolymers of alkyl methacrylates containing 10–20 carbon atoms in the alkyl group, and mixtures of two or more such polyalkyl methacrylates, different in monomer composition and/or molecular weight, as disclosed in GB patent 1,559,952, and extremely high molecular weight polyalkyl methacrylates, as disclosed in U.S. Pat. No. 5,229,021. Said depressant (D) is used in an amount of usually at most 30%, preferably 1–20%, based on the total weight of (A) and (D).

Other Additives

The composition of this invention may further contains one or more additives, usually used in lubricating oils. Such additives include, for example, other VIIs [such as polyolefin VIIs, such as ethylene-propylene copolymer and hydrogenated styrene-isoprene copolymer, detergent VIIs derived from these copolymers by introducing nitrogen thereto; and conventional polyalkyl methacrylate VIIs]; extreme pressure agents [for example, sulfur/phosphorus-containing compounds (such as Anglamol sold by Lubrizol), sulfur-containing compounds (such as sulfurized olefins) and chlorine-containing compounds]; detergents [such as alkaline earth (calcium and magnesium) perbasic salts of sulfonates, salicylates, phenates and naphthenates]; dispersants [for instance, alkenylsuccinimides (such as polyisobutenyl succinimide), Mannich condensates of alkylphenols and polyamines, and boric acid-modified products of these]; anti-oxidants [for example, thiophosphates (such as zinc dithiophosphate), hindered phenols, hindered amines and alkyldiphenylamines]; oiliness additives [such as fatty acids, fatty esters and fatty amides]; rust inhibitors [such as alkylsuccinates, alkylbenzene sulfonates and alkylnaphthalene sulfonates]; and antiwear agent, other than (C), [for example, phosphorus-containing ones, including phosphate and phosphate esters (alkyl, alkenyl and/or aryl phosphates and phosphites containing 4–18 carbon atoms in the hydrocarbyl group), such as mono-oleyl phosphate, tricrezyl phosphate, dibutyl lauroxypropyl phosphate, and di- and tributyl phosphite]. These additives can be used in such amounts: 0–10% of the other VII, 0–10% of the extreme pressure agents, 0–10% of the detergent, 0–10% of the dispersant, 0–5% of the antioxidant, 0–3% of the oiliness additive, 0–5% of the rust inhibitor and 0–10% of the other antiwear agent.

Oil-soluble Alkyl Acrylate Polymer (A1)

In another aspect of the present invention, an oil-soluble alkyl acrylate polymer (A1) is used in combination with an oil-soluble nethacrylate polymer (A2).

Suitable alkyl acrylates (a1), constituting said alkyl acrylate polymer (A1), include straight-chain or/and branched alkyl acrylates containing usually 1–20 carbon atoms in the alkyl group; and include, for example: (a1-1) $C_{5-10}$alkyl acrylates, such as pentyl, hexyl, cyclohexyl, heptyl, octyl, 2-ethylhexyl, decyl and i-decyl acrylates; (a1-2) $C_{1-4}$alkyl acrylates, such as methyl, ethyl, propyl, i-propyl, n-butyl, i-butyl and t-butyl acrylates; $C_{11-22}$ alkyl acrylates, such as dodecyl, tridecyl, tetradecyl, pentadecyl, hexadecyl, octadecyl and eicocyl acrylates; and combinations of two or more of them.

Among these, preferred are $C_{1-10}$alkyl acrylates. More preferred are (a1-1) (particularly octyl acrylate and/or 2-ethylhexyl acrylate), and combination thereof with (a1-2) (particularly butyl acrylate). The weght ratio of (a1-1):(a1-2) is in the range of 100:0–70:30, preferably 95:5–80:20.

Said polymer (A1) comprises usually at least 65%, preferably at least 70% of units of alkyl acrylate (a1).

Said polymer (A1) may contain 0–35%, preferably 5–30%, more preferably 10–25% of units of alkyl methacrylate (a2). Suitable alkyl methacrylates (a2) include the same ones as described below for said alkyl methacrylate polymer (A2).

Said polymer (A1) can further contain, in addition to units of (a1) and optionally (a2), units of one or more additional monomers, if desired, which may be introduced randomly, graft-wise or block-wise. Suitable monomers include polar monomers (a3) and non-polar or less hydrophilic monomers (a4), as mentioned above in regard to said copolymer (A). Among (a4), preferred are acrylonitrile and styrene, for imparting higher VI and bodying effects, respectively. These monomer units can be introduced into said polymer (A1), in the same manner as in (A). The amount of (a3) in (A1) is usually at most 20%, preferably at most 10%, more preferably at most 5%. The content of (a4) in (A1) is generally at most 30%, preferably at most 20%, more preferably at most 10%, in view of oxidation resistance, low temperature viscosity behavior and solubility into lubricationg oils.

Said polymer (A1) can be produced by usual polymerization thechniques, in the same manner as Copolymer (A).

Molecular weight of (A1) can vary widely, according to the use and purpose of lubricating oil compositions. In general, (A1) has a $\overline{Mw}$, as measured by GPC, of generally 10,000–900,000, preferably 30,000–600,000. Polymer of too high molecualr weight results in poor shearing stability, and polymer of too low molecular weight provides insufficient viscosity.

Oil-soluble Methacrylate Polymer (A2)

Suitable alkyl methacrylates (a2), constituting said alkyl methacrylate polymer (A2), are straight-chain or/and branched alkyl methacrylates containing usually 1–20 carbon atoms in the alkyl group; and include, for example, (a2-1) $C_{10-18}$alkyl methacrylates, such as decyl, i-decyl, dodecyl, tridecyl, tetradecyl, pentadecyl, hexadecyl and octadecyl methacrylates; (a2-2) $C_{1-4}$alkyl methacrylates, such as methyl, ethyl, propyl, i-propyl, n-butyl, i-butyl and t-butyl methacrylates; $C_{5-9}$alkyl methacrylates, such as pentyl, hexyl, cyclohexyl, heptyl, octyl and 2-ethylhexyl methacrylates; $C_{20-22}$alkyl methacrylates, such as eicocyl methacrylate; and combinations of two or more of them.

Among these, preferred are combination of (a2-1) (particularly $C_{12-16}$alkyl methacrylate and mixture of two or more of them) with (a2-2) (particularly methyl and butyl methacrylates). The weght ratio of (a2-1):(a2-2) is in the range of 95:5–70:30, preferably 90:10–75:25, in view of low temperature viscosity behavior, oxidative resistance, and solubility into high VI oils and synthetic lubricants.

Said polymer (A2) comprises usually at least 65%, preferably at least 70% of units of $C_{1-18}$alkyl methacrylate.

Said polymer (A1) may contain 0–35%, preferably 5–30%, more preferably 10–25% of units of alkyl acrylate (a1). Suitable alkyl acrylates (a1) include the same ones as described above for said alkyl acrylate polymer (A1).

Said oil-soluble polymer (A2) can further contain, in addition to said units (a2) and optionally (a1), units of one or more additional monomers, if desired, which may be introduced randomly, graft-wise or block-wise. Suitable monomers include polar monomers (a3) and non-polar or less hydrophilic monomers (a4), as mentioned above. Among (a4), preferred are acrylonitrile and styrene, for imparting higher VI and bodying effects, respectively. These monomer units can be introduced into said polymer (A2), in the same manner as in (A). The amount of (a3) in (A2) is usually at most 20%, preferably at most 10%, more preferably at most 5%. The content of (a4) in (A2) is generally at most 30%, preferably at most 20%, more preferably at most 10%, in view of resistance to oxidation, low temperature viscosity behavior and solubility into lubricationg oils.

Said polymer (A2) can be produced by usual polymerization thechniques, in the same manner as Copolymer (A).

Molecular weight of (A2) can vary widely, according to the use and purpose of lubricating oil compositions. In general, (A2) has a $\overline{Mw}$, as measured by GPC, of generally 10,000–900,000, preferably 30,000–600,000. Polymer of too high molecualr weight results in poor shearing stability, and polymer of too low molecular weight provides insufficient viscosity.

Base Oil

Said VII, comprising said acrylate polymer (A1) and said methacrylate polymer (A2) according to this invention, is particularly effective to high VI oils (B), such as those mentioned above.

Said VII comprising (A1) and (A2) is also effective to other lubricating oils, such as usual mineral oils, synthetic lubricants and MLDW oils; as well as mixture of two or more these oils. Usual mineral oils include 50–300 neutral oils, ones obtained from vacuum distilled oils or de-bitumened oils, by removing aromatics therefrom with furfural and then dewaxing with use of a solvent (such as toluene/methylethylketone mixed solvent or propane). Synthetic lubricants include ester lubricants, such as fatty esters of polyhydric alcohols (such as trimethylolpropane, pentaerythritol and 1,6-hexane diol), fatty alcohol esters of poly-carboxylic acids (such as adipic acid), and polyolefin lubricants, for example, poly-alpha-olefins, such as decene-1 oligomer. MLDW oils are ones prepared by mobil lube dewaxing process, and include ones obtainable by isomerizing wax with a catalyst (such as synthetic zeolite) and removing unreacted wax.

Lubricating Oil Composition

The lubricating oil composition of the present invention usually contains said VII, comprising said polymers (A1) and (A2), in a minor portion, such as in an amount of usually 0.3–30%, preferably 0.6–10%, and a lubrication base oil in a major portion, such as in an amount of 65–99.65%, preferably 85–99.35%. The amount of said VII may be varied in accordance with the purpose and use of oils. For instance, said VII is preferably used in an amount of 1–10% in case of engine oil, and 7–25% in case of gear oils and automatic transmission fluids.

In said VII comprising said polymers (A1) and (A2), the content of (A1) is usually 20–80%, preferably 30–70%, and that of (A2) is usually 20–80%, preferably 30–70%. When the content of (A1) is less than 20%, the HTHS viscosity can't be reduced sufficiently. In case of the content of (A1) more than 80%, the amount of coking becomes to be so much.

Said polymers (A1) and (A2) may be added as a mixture or separately to the oil. They may be added to the oil in the form of a concentrate, for example, 30–80% solution of (A1) and/or (A2) in a solvent (such as high VI oil or other oil).

The lubricating oil composition may contain one or more additives, as described below.

Molybdenum-containing Antiwear Agent (C)

Said VII comprising (A1) and (A2) provides excellent resistance to friction and wear and lower fuel cost, when added together with a molybdenum-containing antiwear agent (C). Suitable molybdenum-containing antiwear agent (C) include those mentioned above. Said agent (C) is used in an amount of usually 0.05–5%, preferably 0.1–3%.

Pouring Point Depressant (D)

Preferably, the composition of this invention may further contain a pouring point depressant (D). Suitable depressant (D) include those mentioned above. Said depressant (D) is used in an amount of usually at lost 20%, preferably 1–20%, more preferably 1–10%, based on the total weight of (A1) and (A2), in view of pour point and VI of oil compositions.

Other Additives

The composition of this invention may further contains one or more additives, usually used in lubricating oils. Such additives include, for example, other VIIs [such as polyolefin VIIs, such as ethylene-propylene copolymer and hydrogenated styrene-isoprene copolymer, detergent VIIs derived from these copolymers by introducing nitrogen atoms thereto]; and extreme pressure agents, detergents, dispersants, anti-oxidants, oiliness additives, rust inhibitors, and antiwear agent other than (C), as mentioned above. These additives can be used in such amounts: 0–10% of the other VII, 0–10% of the extreme pressure agents, 0–10% of the detergent, 0–10% of the dispersant, 0–5% of the anti-oxidant, 0–3% of the oiliness additive, 0–5% of the rust inhibitor and 0–10% of the other antiwear agent.

Lubricating oil compositions of the invention, containing said oil-soluble copolymer (A), or said VII comprising said polymers (A1) and (A2), are useful as engine oils (particularly gasoline engine oils and diesel engine oils), gear oil, transmission lubricants (particularly automotive transmission fluid), hydraulic oils, tractor oil, power steering oil, shock-absorber oil, compressor oil, and the like.

Having generally described the invention, a more complete understanding can be obtained by reference to certain specific examples, which are included for purposes of illustration only and are not intended to be limiting unless otherwise specified.

In the following examples, parts represents parts by weight.

With regard to monomers used for producing polymers, the following abbreviations are used:

2-EHA:2-ethylhexyl acrylate; BA:butyl acrylate; 12A:dodecyl acrylate; 12MA:dodecyl methacrylate; 14MA:tetradecyl methacrylate; MMA:methyl methacrylate; 12/13MA:mixture of dodecyl methacrylate and tridecyl methacrylate, prepared from "Dobanol 23" (Shell); 14/15MA:mixture of tetradecyl nethacrylate and pentadecyl methacrylate, prepared from "Dobanol 45" (Shell); 16/18MA:mixture of cetyl methacrylate and octadecyl methacrylate (weight ratio 7:3); ACMD:methacrylamide of 4-aminocarbazole; APMD:N-(4-anilinophenyl)methacrylamide; and VP:N-vinylpyrrolidone.

Synthesis 1 to 8 and Synthesis 1' to 4'

Into a reaction vessel equipped with a stirrer, a thermometer and a condensor, 300 parts of a mineral oil (100 neutral oil) were charged and heated to 70° C. under stirring within an atmosphere of nitrogen. Then, thereto were added dropwise the monomers (parts) written in Table 1 together with 0.9 parts of AVN over 4 hours at the temperature, followed by maintaining the temperature at 70° C. for additional 3 hours to complete the polymerization to obtain solutions of Polymers 1–8 and Polymers 1'–4' having $\overline{Mw}$ and $\overline{Mw}/\overline{Mn}$ as written in Table 1.

Synthesis 9

Into a reaction vessel, were charged 200 parts of Polymer 4 prepared above, 3 parts of VP, 1.8 part of dicumylperoxide and 3 parts of a mineral oil (100 neutral oil), and heated to 140° C. for 4 hours under stirring within an atmosphere of nitrogen to obtain a solution of Polymer 9 having $\overline{Mw}$ of $250\times10^3$ and $\overline{Mw}/\overline{Mn}$ of 2.5.

Synthesis 10 and Synthesis 5'

Synthesis 4 and Synthesis 4' were repeated except using 1.4 parts of LM in addition to 0.9 parts of AVN, to obtain solutions of Polymer 10 having $\overline{Mw}$ of $40\times10^3$ and $\overline{Mw}/\overline{Mn}$ of 2.0 and Polymer 5' having $\overline{Mw}$ of $41\times10^3$ and $\overline{Mw}/\overline{Mn}$ of 2.0, respectively.

TABLE 1

| Polymer No. | 1 | 2 | 3 | 4 | 5 | 6 | 7 | 8 | 1' | 2' | 3' | 4' |
|---|---|---|---|---|---|---|---|---|---|---|---|---|
| BA | — | — | — | — | 30 | — | — | — | — | — | — | — |
| 2-EHA | 90 | 135 | 180 | 135 | 105 | — | 135 | 135 | — | — | — | |
| 12A | — | — | — | — | — | 135 | — | — | — | — | — | — |
| MMA | — | — | — | — | — | — | 30 | 30 | 50 | 15 | 50 | 50 |
| 12MA | — | — | — | 41 | 41 | 41 | — | — | — | — | — | — |
| 14MA | — | — | 120 | 105 | 105 | 105 | — | — | — | — | — | — |
| 12/13MA | 210 | — | — | — | — | — | — | — | 200 | — | 95 | 75 |
| 14/15MA | — | 165 | — | — | — | — | 135 | 135 | — | 200 | 93 | 113 |
| 16/18MA | — | — | — | 19 | 19 | 19 | — | — | 50 | 50 | 62 | 62 |
| ACMD | — | — | — | — | — | — | 6 | — | — | — | — | — |
| APMD | — | — | — | — | — | — | — | 6 | — | — | — | — |
| $\overline{Mw}$, $\times 10^3$ | 220 | 230 | 230 | 210 | 220 | 210 | 220 | 230 | 220 | 220 | 230 | 230 |
| $\overline{Mw}/\overline{Mn}$ | 2.4 | 2.5 | 2.5 | 2.3 | 2.4 | 2.4 | 2.5 | 2.4 | 2.5 | 2.4 | 2.4 | 2.4 |

EXAMPLES 1 TO 9, and COMPARATIVE EXAMPLES 1 TO 4

To a high VI 100 neutral oil (Oil A) having VI of 123 or to a high VI 100 neutral oil (Oil B) having VI of 138, were added 3% of each Polymer shown in Table 2 and 0.5% of a pour point depressant ("Aclube 133", produced by Sanyo Chemical Industries) to provide each oil composition having a viscosity in the range of 10.2–10.6 cSt at 100° C.

HTHS viscosity at 150° C. and cold crack symulator viscosity (hereinafter referred to as CCS viscosity) at −25° C. of oil compositions thus prepared were mesured.

Resistance to oxidation of each composition containing Oil A was evaluated in accordance with JIS K2514, measuring the amounts of sludge (pentane-insuluble matter, %) of Method B. Method B represents the amount of sludge obtained by centrifuging the oil to which a sludge flocculant was added after the test.

The results were as shown in Table 2.

TABLE 2

| Example | Polymer | Viscosity cSt, 100° C. | | HTHS viscosity mPa · s at 150° C. | | CCS viscosity mPa · s at −25° C. | | Sludge Amount |
|---|---|---|---|---|---|---|---|---|
| No. | No. | Oil A | Oil B | Oil A | Oil B | Oil A | Oil B | Oil A |
| Example | | | | | | | | |
| 1 | 1 | 10.4 | 10.5 | 2.93 | 2.94 | 3120 | 3010 | 1.6 |
| 2 | 2 | 10.5 | 10.6 | 2.92 | 2.93 | 3050 | 3000 | 1.4 |
| 3 | 3 | 10.5 | 10.6 | 2.90 | 2.91 | 2900 | 2850 | 1.2 |
| 4 | 4 | 10.3 | 10.4 | 2.91 | 2.93 | 3060 | 3100 | 1.4 |
| 5 | 5 | 10.4 | 10.5 | 2.93 | 2.93 | 3070 | 3060 | 1.5 |
| 6 | 6 | 10.6 | 10.6 | 2.93 | 2.94 | 3100 | 3050 | 1.8 |
| 7 | 7 | 10.2 | 10.3 | 2.93 | 2.94 | 2950 | 2930 | 0.4 |
| 8 | 8 | 10.3 | 10.4 | 2.93 | 2.93 | 2960 | 2920 | 0.3 |
| 9 | 9 | 10.5 | 10.6 | 2.91 | 2.92 | 3120 | 3070 | 1.5 |
| Comparative Example | | | | | | | | |
| 1 | 1' | 10.4 | 10.5 | 3.06 | 3.08 | 4710 | 4510 | 3.8 |
| 2 | 2' | 10.4 | 10.5 | 3.05 | 3.07 | 4800 | 4570 | 4.2 |
| 3 | 3' | 10.5 | 10.6 | 3.08 | 3.10 | 4650 | 4570 | 4.1 |
| 4 | 4' | 10.4 | 10.5 | 3.09 | 3.12 | 4700 | 4530 | 4.0 |

EXAMPLE 10 AND COMPARATIVE EXAMPLE 5

To a high VI 100 neutral oil (Oil A) having VI of 123 or to a high VI 100 neutral oil (Oil B) having VI of 138, were added 16–17% of Polymer 10 or Polymer 5' and 1% of a pour point depressant ("Aclube 133") to provide each oil composition having a viscosity in the range of 7.4–7.6 cSt.

Viscosity at −40° C. of oil compositions thus prepared were mesured. The results were as shown in Table 3.

TABLE 3

| Example No. | Polymer No. | Viscosity cSt. at 100° C. Oil A | Viscosity cSt. at 100° C. Oil B | Viscosity mPa · s at −40° C. Oil A | Viscosity mPa · s at −40° C. Oil B |
|---|---|---|---|---|---|
| Example 10 | 10 | 7.5 | 7.6 | 18,300 | 21,000 |
| Comparative Example 5 | 5' | 7.5 | 7.6 | 34,800 | 39,006 |

EXAMPLES 11 TO 16, AND COMPARATIVE EXAMPLES 6 to 9

To 86 parts of a high VI 100 neutral oil having VI of 131, were added 3 parts of each Polymer shown in Table 4, 1 part of molybdenum dithiophosphate ("Sanflick FM-2", produced by Sanyo Chemical Industries.) or molybdenum dithiocarbamate ("MOLYVAN A", produced by R. T. Vanderbilt Co.) and 10 parts of package additives for engine oil (SG standard oil) to provide each oil composition having a viscosity in the range of 10.2–10.6 cSt at 100° C.

Resistance to oxidation of each composition was tested in accordance with JIS K2514, for 48 hours at 155.5° C. Friction coefficient of each sample after oxidative degradation was measured using an friction tester of SRV Co., under conditions of 50° C., 50 newton load and 50 Hz frequency.

The results were as shown in Table 4.

TABLE 4

| Example No. | Polymer No. | Friction Modifier | Viscosity cSt. 100° C. | Friction Coefficient |
|---|---|---|---|---|
| Example | | | | |
| 11 | 1 | Mo dithiophosphate | 10.2 | 0.19 |
| 12 | 2 | Mo dithiophosphate | 10.3 | 0.18 |
| 13 | 3 | Mo dithiophosphate | 10.3 | 0.19 |
| 14 | 1 | Mo dithiocarbamate | 10.2 | 0.22 |
| 15 | 2 | Mo dithiocarbamate | 10.3 | 0.20 |
| 16 | 3 | Mo dithiocarbamate | 10.3 | 0.21 |
| Comparative Example | | | | |
| 6 | 1' | Mo dithiophosphate | 10.2 | 0.29 |
| 7 | 2' | Mo dithiophosphate | 10.2 | 0.33 |
| 8 | 1' | Mo dithiocarbamate | 10.2 | 0.32 |
| 9 | 2' | Mo dithiocarbamate | 10.2 | 0.38 |

EXAMPLES 17 TO 19, AND COMPARATIVE EXAMPLE 10

Examples 1 to 3 and Comparative Example 1 to 4 were repeated except that a mixture (Oil C) of 50% by volume of Oil A with 50% by volume of usual mineral oil (solvent-refined, having VI of 10.5), or a mixture (Oil D) of 50% by volume of Oil B with 50% by volume of usual mineral oil(solvent-refined, having VI of 10.5) was used instead of Oil A or Oil B.

CCS Viscosity at −25° C. of oil compositions thus prepared were measured in the same manner.

The results were as shown in Table 5.

TABLE 5

| Example No. | Polymer No. | CCS viscosity, mPa · s at −25° C. Oil C | CCS viscosity, mPa · s at −25° C. Oil D |
|---|---|---|---|
| Example 17 | 1 | 3510 | 3420 |
| Example 18 | 2 | 3480 | 3380 |
| Example 19 | 3 | 3410 | 3100 |
| Comparative Example 10 | 1' | 4300 | 4120 |

Synthesis 11 to 20

Into a reaction vessel equipped with a stirrer, a thermometer and a condensor, 300 parts of a mineral oil (100 neutral oil) were charged and heated to 85° C. under stirring within an atmosphere of nitrogen. Then, thereto were added dropwise the initiator and the monomers (parts) written in Table 6 over 3 hours at the temperature, followed by maintaining the temperature at 85° C. for additional 1 hour to complete the polymerization to obtain solutions of Polymers 11–14 and 21–26 having $\overline{Mw}$ and $\overline{Mw}/\overline{Mn}$ as written in Table 6.

Preparations of Concentrates 1 to 12 and 1' to 3'

In accordance to the formulation shown in Table 7, two polymer solution were mixed together with a pour point depressant ("Aclube 133", produced by Sanyo Chemical Industries) at 80° C. to prepare Concentrates 1 to 12 and Concentrates 1' to 3'.

TABLE 6

| Polymer No. | 11 | 12 | 13 | 14 | 21 | 22 | 23 | 24 | 25 | 26 |
|---|---|---|---|---|---|---|---|---|---|---|
| BA | 70 | 70 | — | 70 | 105 | — | — | 105 | — | — |
| 2-EHA | 630 | — | 560 | 630 | — | — | — | — | — | — |
| 12A | — | 630 | — | — | — | — | — | — | — | — |
| MMA | — | — | 70 | — | — | — | 154 | — | 140 | 140 |
| BMA | — | — | — | — | — | 70 | — | — | — | — |
| 2-EHMA | — | — | — | — | 455 | — | 140 | 455 | — | — |
| 10MA | — | — | — | — | — | 630 | — | — | — | — |
| 12MA | — | — | 70 | — | — | — | — | — | 280 | 280 |
| 14MA | — | — | — | — | — | — | — | — | 210 | 210 |
| 16MA | — | — | — | — | — | — | — | — | 70 | 70 |
| 12/13MA | — | — | — | — | — | — | 98 | — | — | — |

TABLE 6-continued

| Polymer No. | 11 | 12 | 13 | 14 | 21 | 22 | 23 | 24 | 25 | 26 |
|---|---|---|---|---|---|---|---|---|---|---|
| 14/15MA | — | — | — | — | 140 | — | 252 | 140 | — | — |
| 16/18MA | — | — | — | — | — | — | 56 | — | — | — |
| Initiator | | | | | | | | | | |
| AIBN | 7 | 7 | 7 | — | 7 | 7 | 7 | — | 7 | — |
| AVN | — | — | — | 0.5 | — | — | — | 0.5 | — | 0.5 |
| $\overline{Mw}$, $\times 10^3$ | 50 | 51 | 49 | 188 | 4.7 | 50 | 49 | 197 | 46 | 188 |
| $\overline{Mw}/\overline{Mn}$ | 2.0 | 2.1 | 1.9 | 2.4 | 1.9 | 2.0 | 1.9 | 2.5 | 1.9 | 2.4 |

TABLE 7

| Concentrate No. | 1 | 2 | 3 | 4 | 5 | 6 | 7 | 8 | 9 | 10 | 11 | 12 | 1' | 2' | 3' |
|---|---|---|---|---|---|---|---|---|---|---|---|---|---|---|---|
| Polymer 11 | 65 | 48 | 30 | — | — | — | — | — | — | — | — | — | — | — | — |
| Polymer 12 | — | — | — | 65 | 48 | 30 | — | — | — | — | — | — | — | — | — |
| Polymer 13 | — | — | — | — | — | — | 65 | 48 | 30 | — | — | — | — | — | — |

EXAMPLES 20 TO 28, AND COMPARATIVE EXAMPLES 11 TO 13

To a high VI 100 neutral oil (Oil E) having VI of 131 or to a usual 100 neutral mineral oil (Oil F) having VI of 105, were added 12–13% of each Concentrate or Polymer written in Table 8 to provide each oil composition having a viscosity in the range of 7.4–7.6 cSt at 100° C.

Viscosity at –40° C. of oil compositions thus prepared were mesured, by Low temperature viscosity testing method (JPI-58-26-85, according to Japan Petroleum Academy).

Resistance to oxidation of some of these compositions was tested in accordance with JIS K2514, for 98 hours at 165.5° C., measuring the amounts of sludge (pentane-insoluble matter, %) of Method B. Method B represents the amount of sludge obtained by centrifuging the oil to which a sludge flocculant was added after the test.

The results were as shown in Table 8.

EXAMPLES 29 TO 34, AND COMPARATIVE EXAMPLES 14 TO 17

To 85.1 parts of a high VI 100 neutral oil (Oil E) having VI of 131 or to a usual 100 neutral mineral oil (oil F) having VI of 105, were added 3.9 parts of each Polymer shown in Table 9, 1 part of molybdenum dithiophosphate ("Sanflick FM-2", produced by Sanyo Chemical Industries.) or molybdenum dithiocarbamate ("MOLYVAN A", produced by R. T. Vanderbilt Co.) and 10 parts of package additives for engine oil (SG standard oil) to provide each oil composition having a viscosity in the range of 10.2–10.6 cSt at 100° C.

Resistance to oxidation of each composition was tested in accordance with JIS K2514, for 48 hours at 165.5° C. Friction coefficient of each sample after oxidative degradation was measured using an friction tester of SRV Co., under conditions of 50° C., 50 newton load and 50 Hz frequency.

The results were as shown in Table 9.

As shown in Examples, oil-soluble copolymers (A) having both units of alkyl acrylate (a1) and units of alkyl methacrylate (a2) are capable of providing reduced HTHS viscosity and CCS viscosity, when added to isoparaffin-containing high VI oils. Besides, said copolymers (A) provide, by using a molybdenum-containing antiwear agent in combination therewith, lower friction coefficient even when oxidative degradation. Thus, lubricating oil compositions according to this invention show improved low temperature flow behavior and high temperature oxidative stability, and are usable even severe conditions and capable of providing lower fuel cost.

In addition, VIIs comprising oil-soluble alkyl acrylate polymer (A1) and oil-soluble nethacrylate polymer (A2) provide improved low temperature flow behavior and oxidation resistance, as compared with oil-soluble methacrylate polymer VIIs. Particularly when added to high VI oils, VIIs comprising (A1) and (A2) provide extremely low viscosity at –40° C. and lower fuel cost.

What is claimed as new and desired to be secured by Letters Patent is:

1. A lubricating oil composition, which comprises:

a minor portion, as a viscosity index improver, of an oil-soluble copolymer (A) having 20–70% by weight of at least one alkyl acrylate unit (a1) containing 5–22 carbon atoms in the alkyl group and 30–80% by weight of at least one alkyl methacrylate unit (a2) containing 1–22 carbon atoms in the alkyl group, and a major portion of an isoparaffin-containing high viscosity index oil (B) having a viscosity index of at least 110.

2. The composition of claim 1, wherein said unit (a2) comprises an alkyl methacrylate unit containing at least 10 carbon atoms in the alkyl group.

3. The composition of claim 1, wherein said unit (a2) comprises an alkyl methacrylate unit (a2-1) containing 10–18 carbon atoms in the alkyl group.

4. The composition of claim 1, wherein said unit (a2) comprises an alkyl methacrylate unit (a2-1) containing 10–18 carbon atoms in the alkyl group and an alkyl methacrylate unit (a2-2) containing 1–4 carbon atoms in the alkyl group.

5. The composition of claim 4, wherein said unit (a2) comprises 60–95% by weight of said unit (a2-1) and 5–40% by weight of said unit (a2-2).

6. The composition of claim 1, wherein said oil (B) has a viscosity index of 120–160.

7. The composition of claim 1, wherein said oil (B) is selected from the group consisting of isoparaffin-containing isomerized mineral oils formed by hydrogenolysis of n-paraffins, and isoparaffin-containing oils formed by hydrogenation and ring-opening reaction of polycyclic aromatics or naphthenes.

8. The composition of claim 1, which comprises 0.3–30% by weight of said copolymer (A).

9. The composition of claim 1, which further comprises a molybdenum-containing antiwear agent (C) in an amount of 0.05–5% by weight.

10. The composition of claim 1, which further comprises a pour point depressant (D) in an amount of up to 30% by weight based on the total weight of said (A) and said (D).

11. A method for improving low temperature flow characteristics and oxidative stability at high temperature in a automobile assembly, which comprises operating the automobile assembly with an engine oil, gear lubricant or brake fluid, containing the composition of claim 1.

12. The composition of claim 1, wherein at least a portion of the monomer units which comprise alkyacrylate unit (a1) is an alkylacrylate monomer in which the alkyl group has not more than 10 carbon atoms.

13. A lubricating oil composition, which comprises:

a minor portion, as a viscosity index improver, of an oil-soluble copolymer (A) comprising 20–70% by weight of alkylacrylate unit (a1) whose alkyl group has 1–22 carbon atoms comprising an alkylacrylate monomer (a1-1) whose alkyl group has 5–10 carbon atoms and an alkylacrylate monomer (a1-2) whose alkyl group has 1–4 carbon atoms and 30–80% by weight of at least one alkylmethacrylate unit (a2) containing 1–22 carbon atoms in the alkyl group, and a major portion of an isoparaffin-containing high viscosity index oil (B) having a viscosity index of at least 110.

14. The composition of claim 13, wherein said unit (a1) comprises 60–90% by weight of said unit (a1-1) and 10–40% by weight of said unit (a1-2).

15. A lubricating oil composition, which comprises:

a minor portion, as a viscosity index improver, of an oil-soluble copolymer (A) having 20–70% by weight of at least one alkyl acrylate unit (a1) containing 5–10 carbon atoms in the alkyl group and 30–80% by weight of at least one alkyl methacrylate unit (a2) containing 1–22 carbon atoms in the alkyl group, and a major portion of an isoparaffin containing high viscosity index oil (B) having a viscosity index of at least 110.

16. A lubricating oil composition, which comprises:

a minor portion, as a viscosity index improver, of an oil-soluble copolymer (A) having 20–70% by weight of at least one alkylacrylate unit (a1) containing 1–22 carbon atoms in the alkyl group and 30–80% by weight of at least alkylmethacrylate unit (a2) containing 1–22 carbon atoms in the alkyl group, and a major portion of an isoparaffin-containing high viscosity index oil (B) having a viscosity index of at least 110;

wherein said unit (a1) comprises at least 60% by weight of the alkylacrylate unit (a1-1) containing 5–10 carbon atoms in the alkyl group.

* * * * *